US006893360B2

(12) United States Patent
Brown

(10) Patent No.: US 6,893,360 B2
(45) Date of Patent: May 17, 2005

(54) GOLF BALL

(75) Inventor: Stanley W. Brown, North Attleboro, MA (US)

(73) Assignee: Acushnet Company, Fairhaven, MA (US)

( * ) Notice: Subject to any disclaimer, the term of this patent is extended or adjusted under 35 U.S.C. 154(b) by 71 days.

(21) Appl. No.: 10/431,022

(22) Filed: May 7, 2003

(65) Prior Publication Data

US 2004/0224792 A1 Nov. 11, 2004

(51) Int. Cl.[7] ..... A63B 37/00
(52) U.S. Cl. ..... 473/351; 427/387
(58) Field of Search ..... 473/351, 378

(56) References Cited

U.S. PATENT DOCUMENTS 3,647,221 A * 3/1972 Holley ..... 473/376
5,827,133 A * 10/1998 Chang ..... 473/370
5,840,788 A 11/1998 Lutz et al. ..... 524/95
5,985,370 A * 11/1999 Ohira et al. ..... 427/387
6,217,464 B1 * 4/2001 Chang ..... 473/378
6,462,303 B1 10/2002 Brown ..... 219/121.69
6,490,968 B2 12/2002 Lutz et al. ..... 101/35
6,540,624 B1 4/2003 Isogawa ..... 473/371
6,544,337 B1 4/2003 Skrabski ..... 118/323

* cited by examiner

*Primary Examiner*—Raeann Gorden
(74) *Attorney, Agent, or Firm*—D. Michael Burns

(57) ABSTRACT

A method of surface treating a golf ball by applying a thin coat of a lubricant having a hydrophilic/hydrophobic character, such as oleic acid. Prior to the stamping of indicia onto the surface of a ball having been prepped with a water-based primer coat, a lubricant is required to aid the ball in a spinning action which is necessary for properly orienting the equator of the ball in a holding mold. After the stamping of indicia, the ball is then painted with a solvent-based clear finishing coat. A thin chemical interface is created wherein the hydrophilic nature of the oleic acid attaches to the primer coat and the hydrophobic nature attaches to the solvent-based finishing topcoat, thereby avoiding compatibility issues between the water and solvent based paints.

7 Claims, No Drawings

GOLF BALL

FIELD OF THE INVENTION

The present invention relates to the use of a surface treatment lubricant to enable a golf ball component to spin into the proper orientation within a holding mold for the imprinting of indicia on the ball.

BACKGROUND OF THE INVENTION

Golf ball covers are routinely marked with various surface indicia, such as the manufacturer's logo and trademark. Also indicia includes the play number, which allows golfers using the same type of golf ball to distinguish one player's ball from that of another. Additional symbols that may also be applied to golf balls include custom figures for promotional purposes, as well as specific marks reflecting manufacturing information. These indicia are generally printed to a painted surface of the golf ball.

Various techniques are used in the stamping of indicia on golf balls. Some of the methods include: direct printing to the ball using a pad; and, hot stamp techniques such as where a transfer foil sheet is used in conjunction with a film and a metal tool. In the later the indicia is transferred from the foil which is prepared with an ink composition, and then a metal tool transfers the indicia from the foil to the film which then hot stamps the indicia on the ball surface. The golf ball is then painted to enhance durability and improve the appearance thereof.

To some golfers, the location of the golf ball's equator is an important consideration, and they rely on the indicia placement to determine this equator position. To insure that the printing of indicia is uniformly correct on all golf balls of a particular type, manufacturers have designed equipment that automatically places a ball into the holding mold with the correct orientation. This requires a certain amount of ball rotation (or spinning), and to facilitate this spinning movement, a lubricant is generally used. The lubrication that has generally been used is petrolatum, which is semi-solid at room temperature and requires heating prior to use. One problem with petrolatum is that it is difficult to accurately dispense, so as to provide uniform coverage over the ball surface. Incomplete lubrication will cause incorrect ball positioning and therefore incorrect stamping of indicia, which will result in excessive rejects. Too much lubrication will present a serious problem at the next process stage, that being the application of a finishing coat (a clear topcoat). An excess of petrolatum remaining on the golf ball may inherently cause "beading" of the clear topcoat and again possible ball rejections. This is due primarily to the incompatibility of petrolatum and solvent based topcoat paints.

It is a long felt need in the industry for a lubricant that provides for proper orientation in the holding mold and is also a compatibility with the solvent-based topcoats.

SUMMARY OF THE INVENTION

An embodiment of the invention provides a method for surface treating a golf ball with a lubricant that has a hydrophilic segment and also a hydrophobic segment. Preferably, a thin coat of oleic acid is applied over golf ball component having a water-based primer coat. This step enables the ball to spin effortlessly for ease of orientation into a mold for the stamping of indicia. After stamping the indicia, the ball is then painted with a solvent-based clear topcoat.

The hydrophilic/hydrophobic character of oleic acid creates a thin chemical interface between the water-based primer and the solvent-based finishing topcoat. The hydrophilic end of the oleic acid attaches to the primer coat while the hydrophobic end attaches to the solvent based finish topcoat. Thus, the use a hydrophilic/hydrophobic lubricant eliminates the incompatibility issue associated with other lubricants and consequently eliminates the necessity of having to clean the lubricant off the ball prior to the application of a topcoat.

An embodiment of the invention provides a golf ball comprised of a primer coat, thin coat of lubricant, indicia stamped on the lubricant coat and a clear topcoat applied on that indicia and lubricant coat.

The surface treating of the invention requires no special equipment except for a low volume, low pressure (LVLP) spray applicator to meter the lubricant onto buffer wheels.

DETAILED DESCRIPTION OF THE INVENTION

The present invention provides for the use of oleic acid as a golf ball lubricant to facilitate accurate positioning of the ball in a holding mold, and Therein precision orientation for the stamping of indicia on the ball surface. All this is accomplished while avoiding compatibility issues with either water-based primer coats or solvent-based topcoats. Oleic acid is a benign mono-unsaturated oil commonly used in the food industry, and is present in fats and oils as a lubricious glyceride. Unlike other lubricants, oleic acid has a segment at one end that is of a hydrophilic character and a segment at the other end which has a hydrophobic segment that makes it very compatible with subsequently applied painted finishes. An important consideration for using oleic acid is that it has a boiling point of 360° C. which makes it very stable.

Prior to having indicia stamped on a golf ball, the ball is treated with a water-based primer coat and then buffed. The lubricant is metered onto a buffing wheel by using a low-volume, low-pressure (LVLP) spray applicator, whereby the lubricant is transferred to the golf ball via the buffing wheel. Having applied the lubricant to the ball, special fixtures precisely align the ball for a series of stamping dies, and the lubricity of the lubricant allows the ball to slide slightly during its final orientation.

The balls are preferably oriented by placing them in cups that have protrusions corresponding to the dimple pattern on the ball and vibrating the cups so that the balls move until they are aligned.

Indicia is then stamped directly onto the hydrophilic/hydrophobic lubricant. After being stamped with indicia, the ball is subsequently coated with a solvent-based clear topcoat, directly onto the indicia and lubricant. Conventionally, coating compositions are applied to a golf ball surface to protect the ball, the identifying indicia, any paint layers, and to add a pleasing appearance to the ball due to their high gloss and the mirror-like surface they produce.

The hydrophilic/hydrophobic character of oleic acid creates a thin chemical interface between the water-based primer and the solvent-based finishing topcoat. The oleic acid molecule attaches its hydrophilic end to the primer coat and its hydrophobic end to the finish topcoat to create the interface. Thus, oleic acid avoids compatibility issues between water or solvent based paints and enhances finish coat leveling.

Unlike petrolatum, which has been a lubricant widely used in the past, oleic acid is a liquid at room temperature, and thus can be easily and accurately dispensed without being heated. Greater accuracy in dispensing results in a more uniform, complete coverage over the golf ball surface. This minimizes areas on the ball that previously may not have received the proper lubrication, and subsequently, the number of ball rejections due to insufficient lubrication is greatly reduced. As previously stated, the oleic acid has a hydrophilic/hydrophobic nature that lends itself compatible to both water-based and solvent-based paints.

Prior to the use of oleic acid, it was necessary to clean the golf balls after they were stamped with indicia. This was a necessary step in order to remove any excess petrolatum lubricant, which could manifest itself by "beading up" and therein contaminating the clear topcoat.

The use of oleic acid for lubricating golf balls has greatly reduced rejection rates of golf balls, both at the indicia stamping stage and at the finishing or topcoat stage. The use of oleic acid eliminates the need to clean the golf balls of lubrication prior to the application of the topcoat.

While the golf ball discussed above has been described as having a primer coat, there are also several means for preparing golf ball surfaces. In addition to buffing, other methods such as sand blasting or plasma treating are often used to prepare the ball surface for printing. In such instances, the surface of the ball may be sprayed with the lubricant. It is also to be appreciated that the application of a clear topcoat is not limited to any particular finishing coat or to only one coat.

As used herein, "indicia" is considered to mean any symbol, letter, group of letters, design, or the like, that can be added to the dimpled surface of a golf ball.

Although the invention has been described with reference of particular means and materials, it is to be understood that the invention is not limited to the particulars disclosed and extends to all equivalents within the scope of the claims.

What is claimed is:

1. A method for surface treating a pre-painted golf ball, the method comprising:

providing the pre-painted golf ball;

applying a lubricant that has a hydrophilic segment at one end of the molecule and a hydrophobic segment at the other end of the molecule;

orienting the ball in a mold wherein the equator of the ball is situated in a predetermined position;

applying indicia onto the surface of the golf ball; and applying a clear topcoat to the surface of the ball.

2. The method of claim 1, wherein the lubricant comprises oleic acid.

3. The method of claim 1, wherein the golf ball has a water-based primer coat applied prior to the applying of the lubricant.

4. The method of claim 1, wherein the lubricant is applied to the golf ball by a metered spraying onto buffing wheels wherein a thin coat is therein applied as the golf ball is buffed.

5. The method of claim 4, wherein the lubricant is metered to the buffing wheels by a low pressure low volume spray applicator.

6. The method of claim 1, wherein the application of indicia onto the surface of the ball is by stamping.

7. The method of claim 1, wherein the topcoat comprises a solvent-based paint.

* * * * *